US007967072B2

(12) United States Patent
McKee

(10) Patent No.: US 7,967,072 B2
(45) Date of Patent: Jun. 28, 2011

(54) LOGGING HEAD RELEASE MECHANISM

(75) Inventor: L. Michael McKee, Friendswood, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 252 days.

(21) Appl. No.: 12/177,375

(22) Filed: Jul. 22, 2008

(65) Prior Publication Data

US 2010/0018692 A1 Jan. 28, 2010

(51) Int. Cl.
*E21B 17/06* (2006.01)
*E21B 23/00* (2006.01)

(52) U.S. Cl. ..... 166/377; 166/385; 285/2; 285/4

(58) Field of Classification Search ..... 166/377, 166/385; 285/2–4; 411/2–5; 403/2
See application file for complete search history.

(56) References Cited

U.S. PATENT DOCUMENTS

| | | | | | |
|---|---|---|---|---|---|
| 1,982,915 | A | * | 12/1934 | Jenks | 285/3 |
| 2,083,054 | A | * | 6/1937 | Cline | 285/2 |
| 4,685,516 | A | * | 8/1987 | Smith et al. | 166/65.1 |
| 4,759,406 | A | * | 7/1988 | Smith et al. | 166/65.1 |
| 5,201,814 | A | * | 4/1993 | Kitchell et al. | 166/65.1 |
| 6,431,269 | B1 | | 8/2002 | Post et al. | |
| 7,114,563 | B2 | | 10/2006 | Rose | |
| 2005/0230115 | A1 | | 10/2005 | Rose | |

* cited by examiner

*Primary Examiner* — Giovanna C Wright
(74) *Attorney, Agent, or Firm* — Michael L. Flynn; Dave Hofman; Jody Desteferis

(57) ABSTRACT

A release mechanism for incorporation into a logging head. The release mechanism may be a tensile release mechanism that employs a plurality of tensile members for interchangeable insertion into a plurality of tensile compartments. As a result, a weakpoint for the logging head may be user defined on location at the oilfield. Furthermore, for potentially deeper wells, a rotatable release mechanism may be alternatively or additionally incorporated into the logging head. The rotatable release mechanism may be employed to effectuate a release of the logging head upon signaling from surface equipment. Additionally, the rotatable release mechanism may be powered to achieve the release solely from a downhole power source.

18 Claims, 6 Drawing Sheets

LOGGING HEAD RELEASE MECHANISM

FIELD

Embodiments described relate to the coupling of downhole tools to a well access line such as a wireline cable. In particular, release mechanisms incorporated into a logging head at the coupling of downhole tools to a well access line are detailed. The release mechanisms described may limit the amount of equipment which may be required at the oilfield prior to a well operation. Additionally, the release mechanisms may employ downhole power in amounts feasibly obtainable from conventional downhole power sources.

BACKGROUND

Exploring, drilling, completing, and operating hydrocarbon and other wells are generally complicated, time consuming and ultimately very expensive endeavors. In recognition of these expenses, added emphasis has been placed on well access, monitoring and management throughout its productive life. Ready access to well information as well as well intervention may play critical roles in maximizing the life of the well and total hydrocarbon recovery. As a result, downhole tools are frequently deployed within a given hydrocarbon well throughout its life. These tools may include logging tools to provide well condition information. Alternatively, these tools may include devices for stimulating hydrocarbon flow, removing debris or scale, or addressing a host of other well issues.

The above noted downhole tools are generally delivered to a downhole location by way of a well access line, often a wireline cable. Once positioned downhole at the end of the well access line a well application may be employed by such a tool. A winch at the surface of the oilfield may then be employed to withdraw the well access line and tool from the well. However, in many cases the tool may be stuck in place downhole. This may be due to the presence of an unforeseen obstruction, unaccounted for restriction, differential sticking of the tool against the well wall, a malfunctioning tractor, or a host of other reasons. Indeed, with the presence of increasingly deeper and more deviated wells, the likelihood of a downhole tool becoming stuck merely due to the depth and architecture of the well alone is increased.

Regardless of the particular reason for the sticking of the downhole tool, continued withdrawal of the well access line by the winch may lead to significant line or tool damage. Furthermore, continued driving of the winch is likely to result in breaking of the well access line, leaving potentially several thousand feet of line in the well if preventable measures aren't taken. Thus, in order to help avoid a circumstance in which the well access line is broken, a release mechanism is generally incorporated into the logging head which serves as the connection between the downhole tool and the well access line. In this manner, the winch may continue to pull the line out of the well, leaving only the downhole tool and part of the logging head behind. A subsequent fishing application may take place in order to retrieve the tool and logging head remains.

One type of release mechanism involves using a separable housing that is held together by at least one tensile stud. The housing makes up the body of the logging head which may be broken once a predetermined load is applied to the tensile stud thereof. Often this is referred to as incorporating a "weakpoint" into the logging head through the use of the tensile stud. For example, consider a tensile stud providing a weakpoint of about a 2,000 lb. threshold to a logging head coupled to a tool stuck in the well. In such a case, the logging head will break, freeing the well access line from the well once the pull of the winch exceeds about 2,000 lbs.

Unfortunately, employing a tensile stud incorporated into the housing of the logging head requires that the tensile stud and load threshold be predetermined. That is, the most effective size of the threshold to be incorporated into the logging head may be dependent on a variety of factors. For example, the load threshold of the well access line itself, the potential sticking depth of the tool, and the overall size of the downhole toolstring may all play a role in determining the most effective tensile stud to use. As a practical matter, this means that a couple of different logging heads and between about 10 and 20 different tensile studs of different load thresholds, or "weakpoint" values, are generally made available at the oilfield. In spite of this large amount of equipment, only one of the tensile stud/head combinations are ultimately incorporated into the overall line assembly.

Often times, in an effort to minimize the amount of equipment brought to the site, an operator will bring fewer tensile studs to the site leaving fewer weakpoint values available. However, this runs the risk that the proper logging head will be unavailable on site adding significant delay to the operation or worse, the employment of an improper logging head of potentially catastrophic consequences. At a minimum, the operator is left with the option of hauling a significant number of unutilized studs to the site or risk the possibility of hundreds of thousands of dollars in lost time for failure to do so.

Alternative types of release mechanisms are often employed where the load threshold of the tensile stud would need to be fairly minimal in order to be effective. So, for example, where 15,000 lbs. of line are disposed within the well and the line has a load threshold of 16,000 lbs., this effectively leaves the possibility of employing a tensile stud of less than a 1,000 lb. threshold. Thus, rather than employ such a minimal tensile stud, a remote release mechanism such as an explosive charge or an electrically actuated mechanism positioned at the logging head may be used to free the wireline from a tool stuck downhole.

Unfortunately, employing an explosive charge for use with a logging head release mechanism comes with the inherent risks associated with the use of explosives for any purpose. That is, operator safety has potentially been compromised due to the possibility of accidental discharge. On the other hand, providing electrical power downhole may be a significant challenge. For example, conventional techniques for electrically actuating a release mechanism require several amps of power. As a result, where an electrical release mechanism is employed, electrical cable is generally added onto the well access line in order to meet the power requirements. Given that the well is likely of significant depth, this means that a considerable amount of weight has been added to the line in order to employ such a release mechanism. As such, the overall effectiveness of the operation itself may be compromised.

SUMMARY

A logging head is provided for a downhole tool. The logging head includes a line connection for coupling to a well access line and a tool connection for coupling to a downhole tool. The logging head also includes a housing between the line and tool connections with a plurality of tensile member compartments for accommodating a plurality of interchangeable tensile members of individual load bearing capacity.

In another embodiment the logging head again includes line and tool connections for coupling to a well access line and a downhole tool, respectively. However, the logging head also includes a piston simultaneously coupled to the line and tool connections. The coupling between the piston and the tool in particular is achieved through a downhole powered rotatable release mechanism. In one embodiment, this mechanism is a downhole powered rolling release mechanism configured to employ rolling friction to release the piston from the downhole tool.

DETAILED DESCRIPTION

Embodiments are described with reference to certain downhole tool operations at an oilfield. For example, logging operations with a downhole logging tool in a well at an oilfield are described throughout. However, alternate downhole operations and tools may be utilized in conjunction with embodiments of a logging head as described herein. Regardless, embodiments of the logging head include a release mechanism that may be particularly suited to minimizing equipment requirements at the oilfield and/or may be configured to take advantage of conventionally available downhole power sources.

Figure 1:
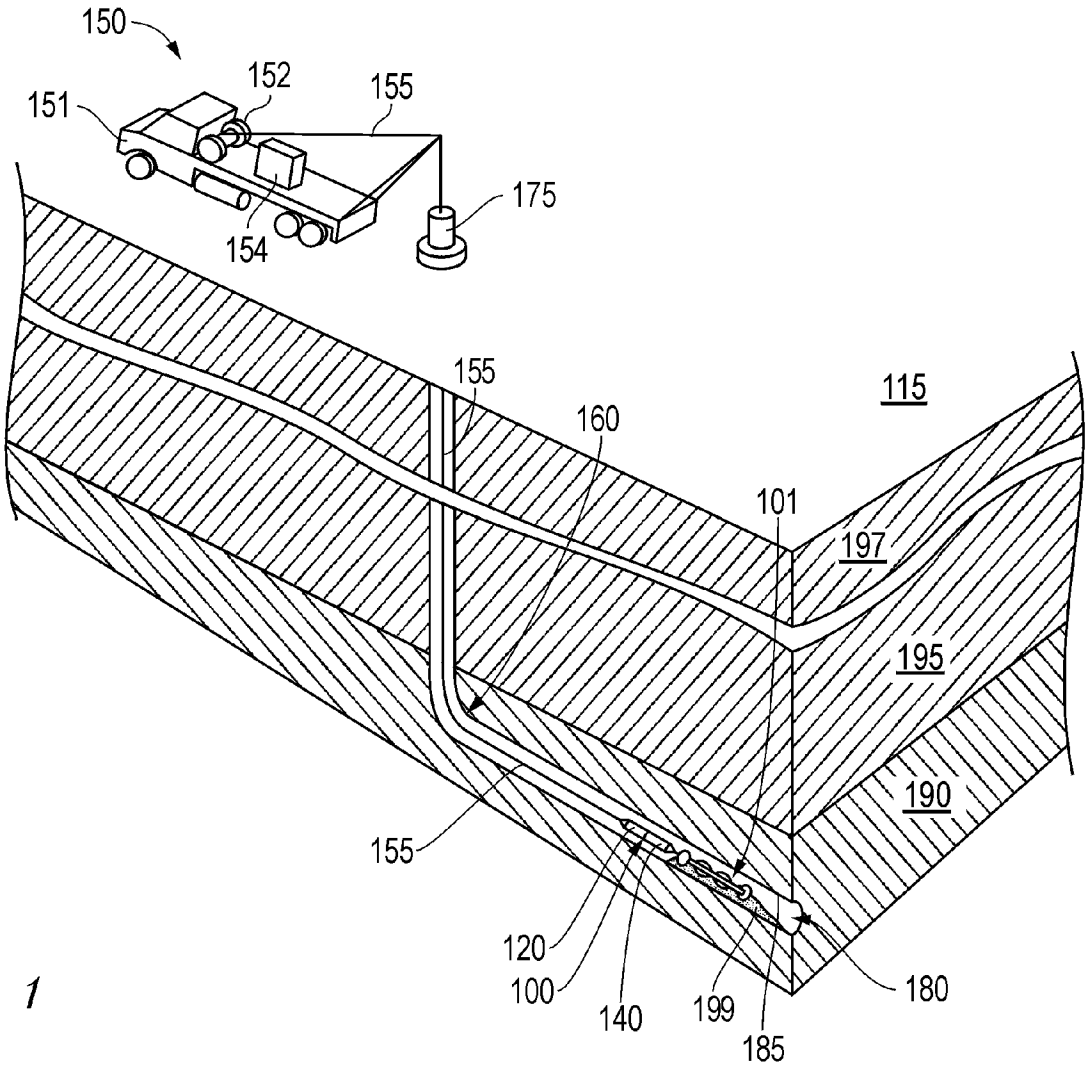
FIG. 1 is a perspective overview of an oilfield depicting a well access line coupled to a downhole tool in a well through an embodiment of a logging head.

Referring now to FIG. 1, an overview of an oilfield 115 is depicted. In this figure, a deviated hydrocarbon well 180 is shown through formation layers 190, 195, 197 of the oilfield 115. A well access line in the form of a wireline 155 is employed for positioning of a downhole tool 101 within the well 180. In the embodiment shown, the downhole tool 101 is a logging tool to provide profile data relative to the well 180 and surrounding formation layers 190, 195, 197. However, in other embodiments, other types of downhole tools 101 may be employed. Additionally, a logging head 100 is provided for coupling of the downhole tool 101 to the wireline 155.

In the embodiment shown, the downhole tool 101 is lodged within debris 199 of the well 180. This may be a result of differential sticking, whereby the well 180, which may be of fairly low pressure relative to a neighboring hydrocarbon reservoir, is intentionally pressurized as a means of control. In such circumstances, differential sticking may occur where circulating mud or fluid within the pressurized well 180 is forced against the wall 185 of the well 180, often grabbing onto a downhole implement such as the depicted tool 101. Of course, the downhole tool 101 may become stuck downhole for a variety of other reasons as well, such as an encounter with an obstruction such as a sharp bend 160 or other architectural feature of the well 180, an unaccounted for restriction, or the presence of a malfunctioning tractor or other large piece of downhole equipment.

In the face of the above noted sticking, the logging head 100 is configured with at least one release mechanism in order to allow potentially several thousand feet of wireline 155 to be safely removed without breaking. That is, once stuck downhole as depicted, forces could potentially be imparted on the wireline 155, through a winch 152, which exceed the physical tolerance of the wireline 155. In other words, the wireline 155 is susceptible to being broken in an attempt to remove the stuck tool 101 from the well 180. Therefore, in order to prevent this from happening, the logging head 100 is equipped with a release mechanism that is configured to allow the head 100 to break as opposed to the wireline 155. So, for example, where the wireline 155 has a threshold of 10,000 lbs., the logging head 100 may be configured to break between uphole 120 and downhole 140 portions thereof, once a 5,000 lb. load is imparted thereon. As such, the logging head 100 will break, allowing the wireline 155 to come free and be removed from the well 180 by the winch 152 before it can be broken.

Subsequently, a fishing operation may proceed in order to remove the downhole portion 140 of the logging head 100 along with the downhole tool 101. However, by ensuring that the logging head 100 is broken in advance of the wireline 155, potentially thousands of feet of the well 180 are saved from obstruction by a broken wireline 155. In embodiments described herein, this may be achieved by release mechanisms incorporated within the logging head 100. These release mechanisms may be configured to minimize the amount of equipment required on site at the oilfield 115. Additionally, release mechanisms may be employed which are configured to take advantage of conventionally available downhole power sources which may provide no more than about 10 watts of power.

Figure 2:
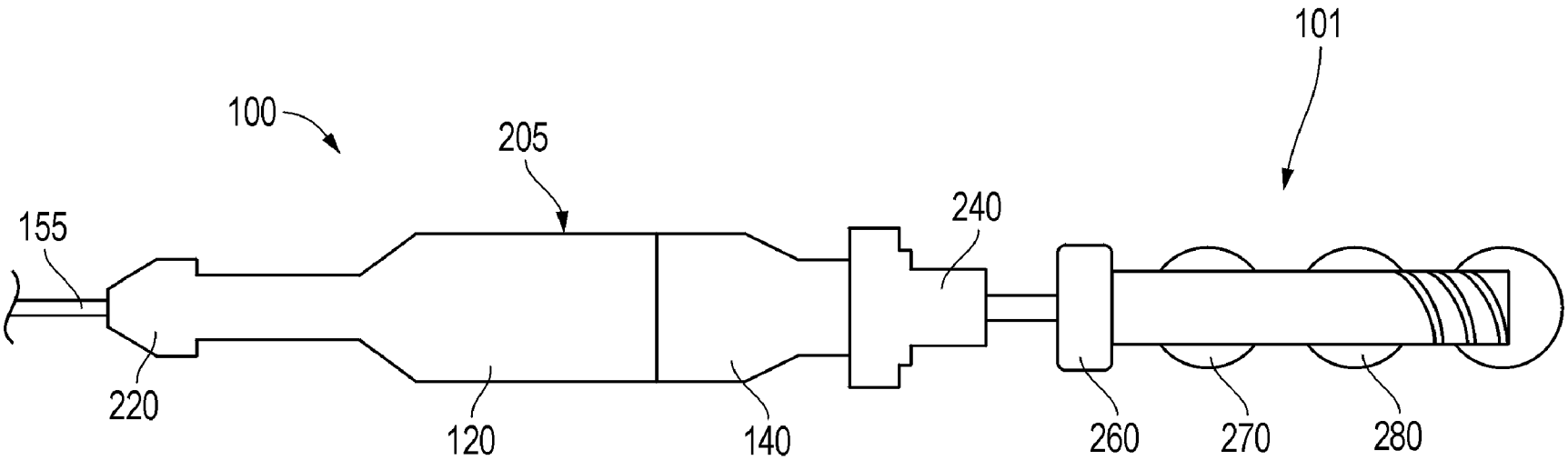
FIG. 2 is an enlarged side view of the well access line, downhole tool and logging head of FIG. 1.

Continuing with reference to FIGS. 1 and 2, the operation depicted at the oilfield 115 may be a logging operation within the well 180 wherein the downhole tool 101 is employed to determine a variety of characteristics of the well 180. Such a logging operation may be undertaken to help build or update an overall profile of the well 180 relative to pressure, temperature, and other obtainable downhole data. In order to obtain the data, surface equipment 150 may be utilized to position the tool 101 within the well 180. In particular, the above-noted winch 152, supported by a conventional wireline truck 151, may be used to drop the tool 101 and other equipment into the well 180. The operation itself may be directed with the aid of a processing unit 154 of the truck 151. The processing unit may similarly store and update the well profile data acquired by the downhole tool 101.

With particular reference to FIG. 2, well profile data may be acquired by a variety of implements 260, 270, 280 of the downhole tool 101. For example, the tool 101 may include a saturation implement 260 to establish fluid flow information, an imaging implement 270, an accelerometer 280, and other implements for attaining downhole information. Additionally, the tool 101 itself may be coupled to the logging head 100 at a tool connection 240 of the head 100. As indicated above, a body 205 of the logging head 100 is separable into uphole 120 and downhole 140 portions once a predetermined load is imparted on a release mechanism of the head 100. Thus, the downhole tool 101 along with the downhole portion 140 and the tool connection 240 of the logging head 100, may be disposed of downhole as described above, should the tool 101 become stuck. Similarly, the uphole portion 120 of the logging head, along with a line connection 220 may be drawn uphole by the wireline 155.

Figure 3A:
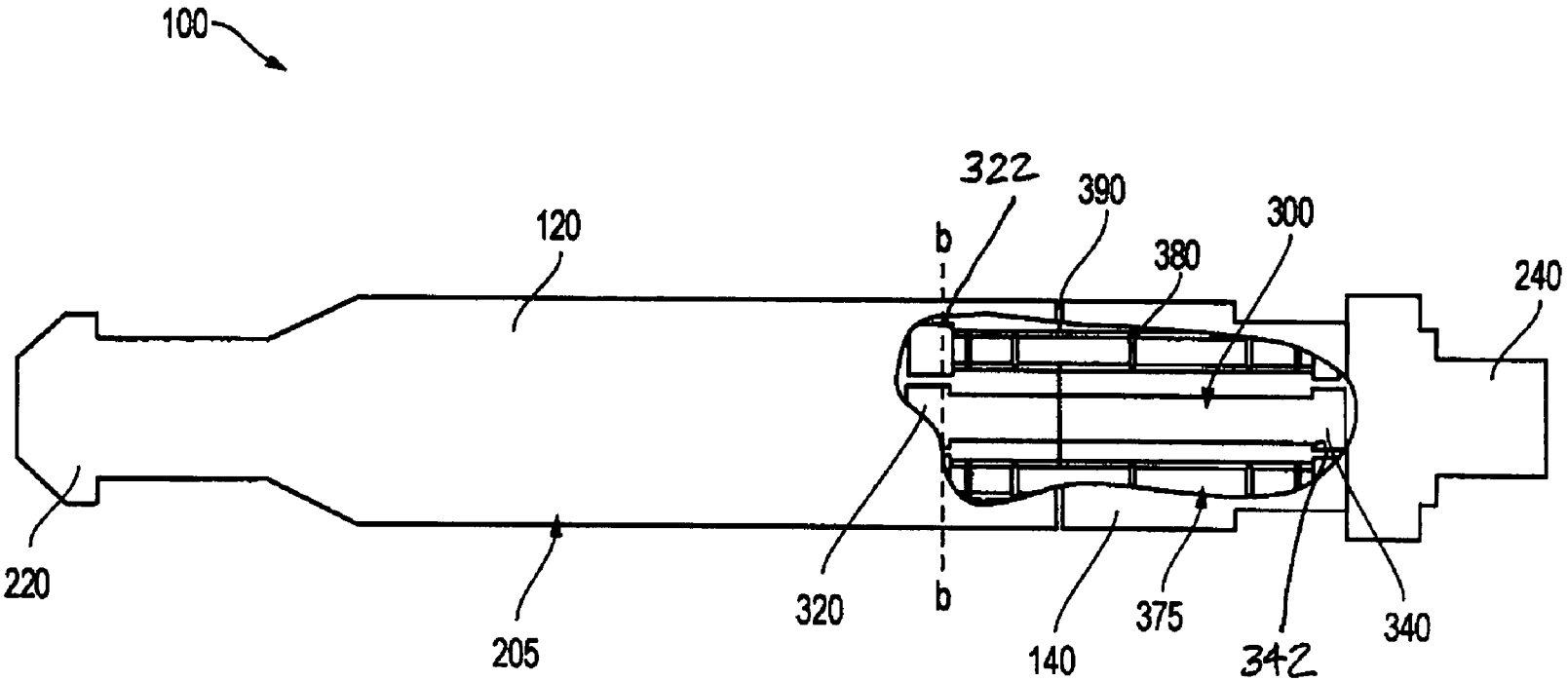
FIG. 3A is a partially sectional view of the logging head of FIGS. 1 and 2 revealing an embodiment of a tensile release mechanism therein.

Referring now to FIG. 3A, an embodiment of a release mechanism of the logging head 100 is detailed. Namely, a tensile release mechanism is described which is positioned between the line 220 and tool 240 connections of the logging head 100. The tensile release mechanism includes a plurality of tensile member compartments 300 in the body 205 of the logging head 100. The compartments 300 are configured to securely accommodate a plurality of interchangeable tensile members 375. In this embodiment, the body 205 of the logging head 100 is held together by the presence of tensile members 375 disposed within the tensile member compartments 300. The uphole 120 and downhole 140 portions of the body 205 are separable from one another at a body interface 390 as alluded to above. However, the tensile members 375 may be placed within the compartments 300 in order to span the body interface 390, thereby holding the portions 120, 140 together.

As depicted in FIG. 3A, each compartment 300 includes an uphole 320 and a downhole 340 cavity defining respective engagement surfaces 322 and 342 for securely retaining uphole 382 and downhole 384 heads of the tensile members 375 (see FIG. 3C) by engaging the surfaces 322, 342 with respective engagement surfaces 383 and 385 on the uphole 382 and downhole 384 heads. The surfaces 322 and 324 are substantially parallel to the surfaces 383 and 385. Thus, the above noted body portions 120, 140 may be held together as described until a predetermined total load sufficient to break all of the tensile members 375 is imparted on the logging head 100. In the embodiment shown, the tensile members 375 are each equipped with a breakpoint 380 on a portion 381 of the tensile member 375 intermediate the uphole 382 and downhole 384 heads. The breakpoint 380 is configured to break upon encountering an individual predetermined load.

Each tensile member 375 may be configured to break upon encountering a load of between about 1,000 lbs. and about 3,000 lbs. However, given that the tensile members 375 are positioned in parallel about a central axis of the logging head 100, the predetermined total load sufficient to break all tensile members 375 is cumulative. Stated another way, the tensile members 375 cumulatively combine to define the weakpoint value of the logging head 100. Thus, in an embodiment where up to six tensile members 375 may be incorporated into the logging head 100 with individual load thresholds of about 1,000 to 3,000 lbs., the predetermined total threshold, or 'weakpoint' of the head 100, may be anywhere from 1,000 to 18,000 lbs. as detailed further below.

Figure 3C:
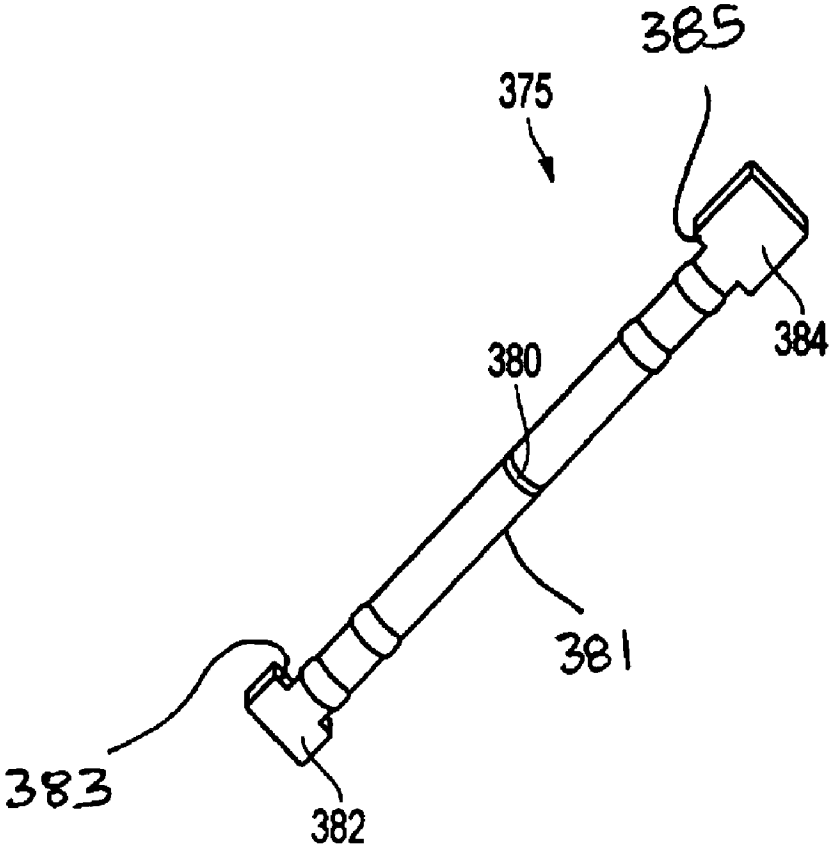
FIG. 3C is a perspective view of an embodiment of a tensile member of the tensile release mechanism of FIG. 3A
Figure 3B:
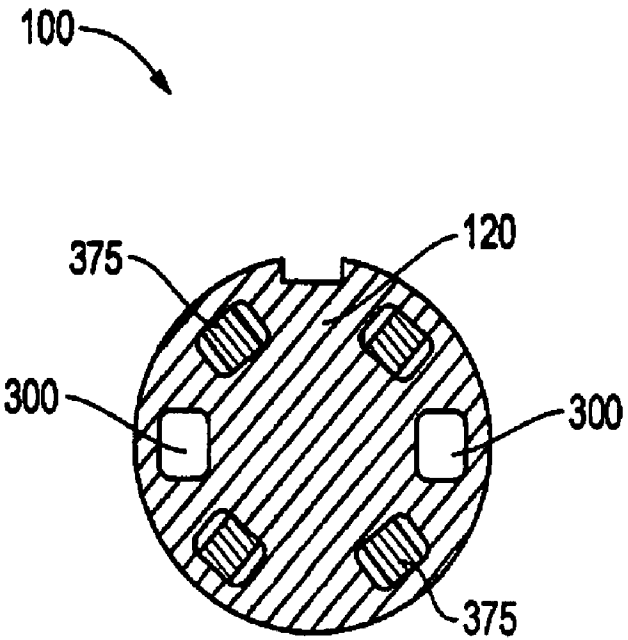
FIG. 3B is a cross-sectional view of the logging head taken from b-b of FIG. 3A.

Continuing with added reference to FIG. 3B, a cross-section taken from b-b of FIG. 3A is depicted. In this embodiment, four of the six tensile member compartments 300 are depicted securing individual tensile members 375. Of course, depending on the individual tensile member load threshold options available and the particular application run with the logging head 100, anywhere from just one of the compartments 300 to all six may be occupied with tensile members 375. For example, in one embodiment a suite of 12 tensile members 375 may be made available for a six compartment logging head 100 as shown. The tensile members 375 may be of two different load threshold values, say six at 1,000 lbs. and six at 2,000 lbs. Thus, with four tensile members 375 employed as depicted, a user may configure a weakpoint for the logging head 100 spanning a range of between 4,000 and 8,000 lbs. (in 1,000 lb. increments).

It is of note that the tensile members 375 are interchangeable and a variety of different combinations may be selected in configuring a weakpoint for the logging head 100. For example, as a matter of enhancing stability, the tensile members 375 may be placed in parallel and in pairs. That is, continuing with the example above, a 1,000 lb. threshold member 375 may be placed opposite another 1,000 lb. threshold member 375 whereas a 2,000 lb. threshold member 375 may be placed opposite another 2,000 lb. threshold member 375. However, this is not required. Indeed, in one embodiment, only a single tensile member 375 may be employed in the logging head 100 without any concern over an oppositely positioned member 375. Similarly, tensile members 375 of different thresholds may be employed simultaneously within the logging head 100.

Continuing with reference to FIGS. 3A-3C, the availability of a suite of interchangeable tensile members 375 as described reduces the amount of equipment that may be required on site. That is, with added reference to FIG. 1, the operator may seek to account for the load threshold of the wireline 155, the potential depth of tool deployment, and a variety of other factors at the oilfield 115 when assembling downhole equipment. However, with a suite of interchangeable tensile members 375 available, the operator may avoid bringing a host of different logging heads 100 to the oilfield 115 to make the on-site weakpoint determination. Rather, the operator may configure a weakpoint for a single logging head 100 right at the oilfield 115 without concern over whether or not the proper logging head 100 was brought to the site. So, for example, sticking with the example suite of tensile member thresholds noted above, 1,000 lbs. and 2,000 lbs., the operator may construct a weakpoint for the logging head 100 that is anywhere from 1,000 lbs. to 12,000 lbs.

The suite of interchangeable tensile members 375 may be provided in a user friendly manner from the operator perspective. In one embodiment, the tensile members 375 are provided in a carrying case similar to a consumer drill bit case. With such interchangeable tensile member sizing conveniently available, the odds of the operator failing to employ the proper weakpoint for the logging head 100 is substantially minimized.

While a more complete range of weakpoint construction may be made readily available by a suite of tensile members 375 as described above, it may be preferable to separate the body 205 of the logging head 100 in a manner that avoids imparting a significant load on the head 100 altogether. That is, the tensile release mechanism described above involves separation of the uphole 120 and downhole 140 portions of the body 205 based on imparting of a load on the logging head 100. However, referring again to FIGS. 1 and 2, an additional option of obtaining a separation of the body 205 without requiring breaking of the head 100 by imparting a load thereon may be beneficial. For example, in a scenario where the well 180 is of a depth far exceeding 20,000 ft., it would not be uncommon for a 16,000 lb. threshold wireline 155 to have a load of 15,000 lbs. exerted thereon simply due to its own weight and friction. This would leave only 1,000 lbs. of play within which to configure a tensile release mechanism. Thus, as described below, the logging head 100 may additionally or alternatively be equipped with a rotatable release mechanism which avoids use of a predetermined load to physically break apart the logging head 100.

Figure 4A:
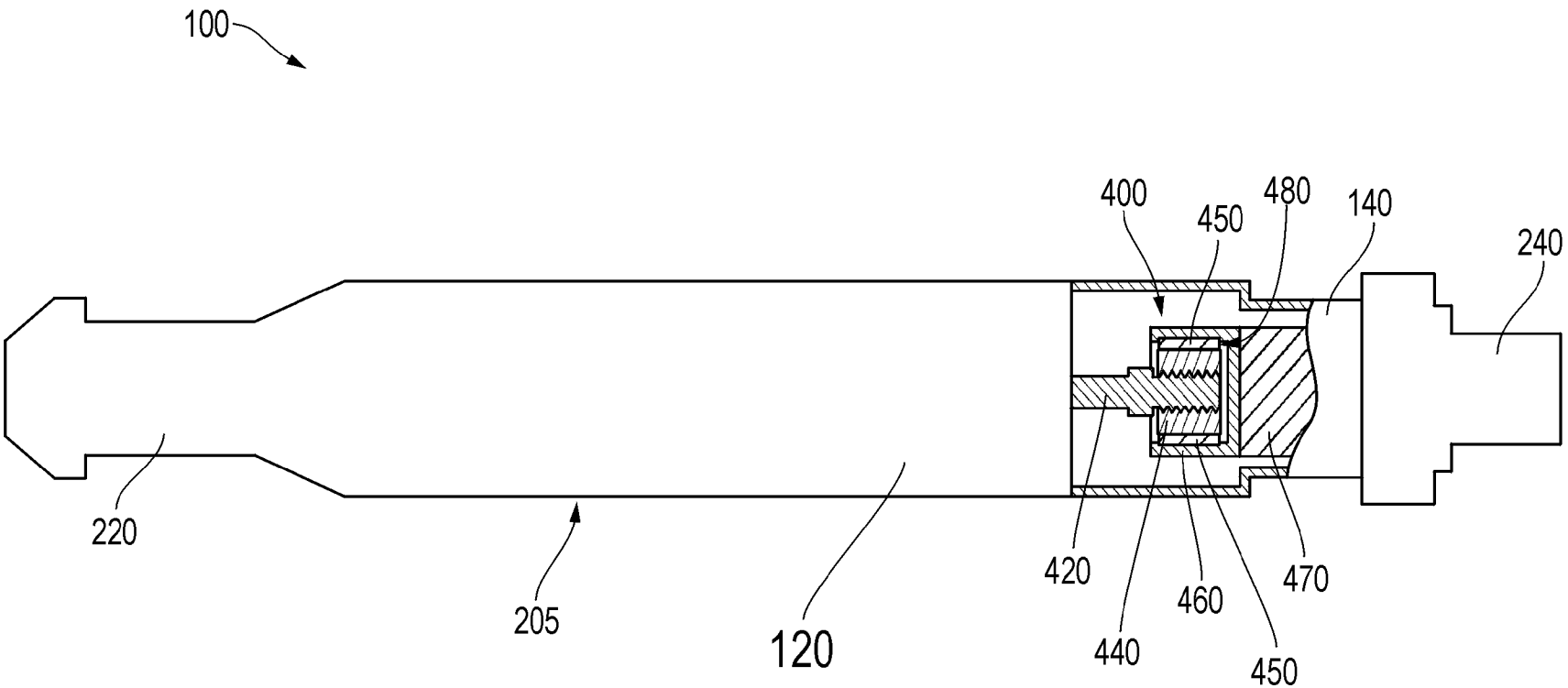
FIG. 4A is a partially sectional view of the logging head of FIGS. 1 and 2 revealing an embodiment of a rotatable release mechanism therein.

Referring now to FIG. 4A, the logging head 100 is shown with a rotatable release mechanism. The mechanism includes a piston 420 integral with the uphole portion 120 of the body 205 which is releaseably retained by a rotatable assembly 400 integral with the downhole portion 140 of the body 205. As detailed below, and with added reference to FIG. 1, the rotatable assembly 400 may be responsive to a signal from surface equipment. For example, a predetermined load may be detected or a predetermined amount of time elapsed which may be indicative of a stuck tool 101 as shown in FIG. 1. In such a circumstance, the rotatable release mechanism may be actuated by surface equipment. Of particular note is the fact that the rotatable release mechanism may be powered by a downhole power source supplying less than about 10 watts of power in order to achieve separation of the uphole 120 and downhole 140 portions of the logging head 100.

Figure 4B:
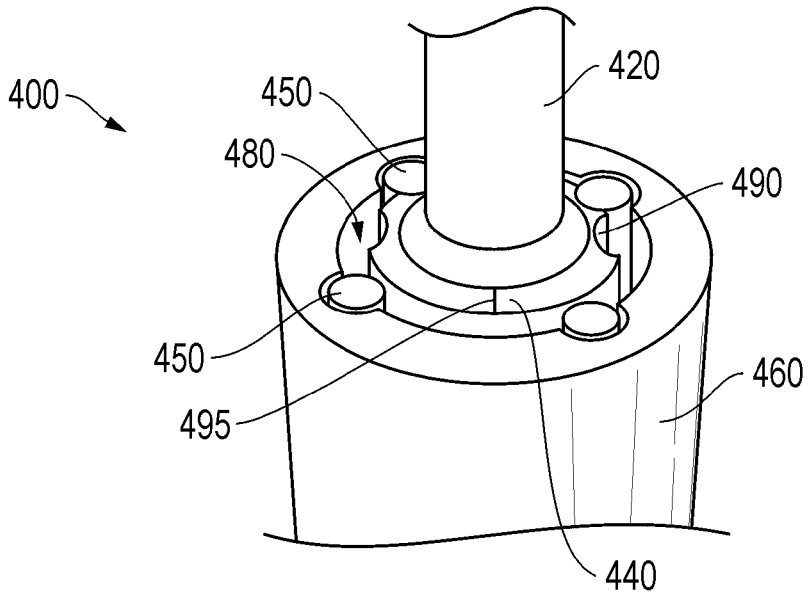
FIG. 4B is a perspective view of the rotatable release mechanism of FIG. 4A in a secured position.

Continuing now with reference to FIGS. 4A and 4B, the rotatable assembly 400 secures the piston 420 with a split inner race 440 that is compressively forced against the piston 420 by more exterior features of the assembly 400. Namely, a set of roller bearings 450 may be wedged between the split inner race 440 and a unitary outer race 460, thereby holding the split inner race 440 about an end of the piston 420. In this manner, the piston 420 may be secured within the rotatable assembly 400 keeping the logging head 100 together.

Prior to actuation, the rotatable assembly 400 secures the piston 420 as shown in FIG. 4A by employing the roller bearings 450 to maintain a separation 480 between the inner 440 and outer 460 races. However, the inner race 440 is also split as noted above. That is, the inner race 440 may be separated along a race interface 495 that exists between two structural halves of the race 440 itself. Nevertheless, when oriented as depicted in FIG. 4A, the inner race 440 is held together about the end of the piston 420 as described, in order to hold the logging head 100 together.

Figure 4C:
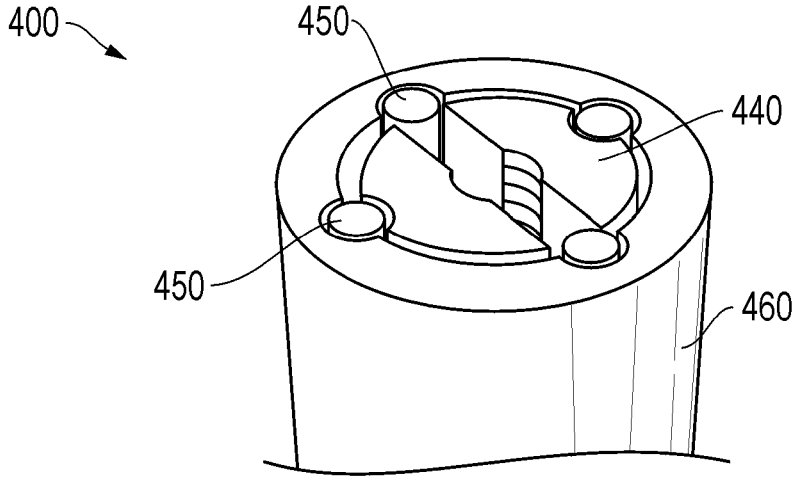
FIG. 4C is a perspective view of the rotatable release mechanism of FIG. 4A in a released position.

Continuing with reference to FIGS. 4B and 4C, with added reference to FIG. 1, a determination may be made to actuate the release mechanism. As such, a fiber optic or other signal may be directed downhole for actuation of the rotatable release mechanism. In particular, the rotatable release mechanism may act to reorient the position of the inner 440 and outer 460 races relative to one another through the roller bearings 450. As depicted in FIG. 4C and described further below, this may result in positioning the roller bearings 450 at the race interface 495 and recesses 490 of the inner race 440 such that it is allowed to separate. As a result, the piston 420 of FIG. 4B may be released, allowing the logging head 100 to separate thereby avoiding breaking of the wireline 155 (see FIG. 1).

With added reference to FIG. 4A, the outer race 460 is rotated from a set position as depicted in FIG. 4B to a release position as depicted in FIG. 4C. This rotation occurs along the roller bearings 450. Thus, a minimal rolling friction is overcome by the rotating outer race 460 in order to attain the release position depicted in FIG. 4C. That is, as opposed to shearing or other more significant friction, the outer race 460 is able to attain the release position with a minimal amount of power as described below.

In order to rotate the outer race 460 as described above, a motor 470 is coupled thereto. However, this motor 470 may operate to rotate the outer race 460 as described above with less than 10 watts of power. Indeed, due to the minimal amount of rolling friction which is overcome in rotating the outer race 460, the motor 470 may operate at no more than about 3 watts of power in one embodiment. Furthermore, due to the minimal power required to rotate the outer race 460, a conventional mobile downhole power supply may be employed. So, for example, a standard downhole battery pack located at the tool connection 240 or the tool 101 may be wired to the motor 470 to power the described release of the piston 420 from the rotatable assembly 400. As a result, extensive power cabling need not be run from the surface of the oilfield 115 in order to power the rotatable assembly 400 (see FIG. 1).

In one embodiment, the power source may also be set to automatically actuate the release mechanism without uphole direction. That is, the release mechanism may be set to release after a predetermined amount of time, for example, about 48 hours after the start of the downhole application. In this manner, the release mechanism may be set for actuation at a time following the downhole application. Thus, in circumstances where uphole communication is lost and the tool 101 is stuck, actuation of a release may nevertheless be achieved.

For deeper wells where a tensile release mechanism may be a less preferred option, and where explosive charges are almost never desired, embodiments described above include a rotatable release mechanism that may be employed as a logging head release mechanism. This mechanism may be run on minimal power thereby allowing for the avoidance of substantial lengthy electrical cabling that might otherwise affect the performance of the operation, particularly at the wireline or other well access line.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, embodiments described herein focus on a well access line that is a wireline cable. However, any number of well access lines, including coiled tubing and others, may be employed with embodiments of logging heads as described hereinabove for a host of different operations. Furthermore, the foregoing description should not be read as pertaining only to the precise structures described and shown in the accompanying drawings, but rather should be read as consistent with and as support for the following claims, which are to have their fullest and fairest scope.

I claim:

1. A logging head for disposing a downhole tool in a well, the logging head comprising:

an uphole portion having a line connection for coupling to a well access line;

a downhole portion having a tool connection for coupling to a downhole tool; and a body comprising said portions and an interface of said portions and having a plurality of tensile member compartments for accommodating a plurality of tensile members of individual predetermined load bearing capacity, wherein each tensile member compartment includes an uphole cavity uphole of the interface and a downhole cavity downhole of the interface, and wherein each tensile member spans the interface and comprises an uphole head for securing in the uphole cavity and a downhole head for securing in the downhole cavity.

2. The logging head of claim 1 wherein each uphole cavity and downhole cavity comprises an surface for engaging with a respective surface of the uphole head and the downhole head for securing the heads in the respective cavities.

3. The logging head of claim 1 wherein the tensile members are of an interchangeable configuration.

4. The logging head of claim 1 wherein, the individual predetermined load bearing capacity of each of the tensile members cumulatively defines a weakpoint value of the logging head.

5. The logging head of claim 1 wherein the load bearing capacity is between about 1,000 lbs. and about 2,000 lbs.

6. The logging head of claim 1 wherein the plurality of tensile members includes a first tensile member of a first load bearing capacity and a second tensile member of a second load bearing capacity different from the first load bearing capacity.

7. The logging head of claim 1 wherein the plurality of tensile members includes a first tensile member positioned opposite a second tensile member of about the same load bearing capacity.

8. A logging head for disposing a downhole tool in a well, the logging head comprising:

an uphole portion having a line connection for coupling to a well access line;

a downhole portion interfacing the uphole portion and having a tool connection for coupling to a downhole tool; and a body comprising said portions and an interface of said portions and housing a release mechanism to control separating of said uphole portion from said downhole portion, the release mechanism comprising one of:

a plurality of tensile member compartments in said body for accommodating a plurality of tensile members of individual predetermined load bearing capacity wherein each tensile member compartment comprises an uphole cavity uphole of the interface and a downhole cavity downhole of the interface, and wherein each tensile member spans the interface and comprises an uphole head for securing in the uphole cavity and a downhole head for securing in the downhole cavity; and a rotatable assembly secured within one of said portions for releasably coupling to a piston of the other of said portions.

9. The logging head of claim 8 wherein the tensile members are of an interchangeable configuration.

10. The logging head of claim 8 wherein the separating is powered by no more than about 10 watts of power.

11. The logging head of claim 8 wherein the well access line is one of a wireline cable and coiled tubing.

12. A method for attaching a logging head to a downhole tool for use in a well, comprising:

providing a logging head comprising an uphole portion having a line connection for coupling to a well access line, a downhole portion having a tool connection for coupling to a downhole tool, and a body comprising the uphole and downhole portions, an interface of said portions, and a release mechanism, wherein the release mechanism comprises a plurality of tensile member compartments in said body for accommodating a plurality of tensile members of individual predetermined load bearing capacity, wherein each tensile member compartment comprises an uphole cavity uphole of the body and a downhole cavity downhole of the body, and wherein each tensile member spans the interface and comprises an uphole head for securing in the uphole cavity and a downhole head for securing in the downhole cavity;

attaching the logging head to the well access line and the downhole tool;

configuring the release mechanism to release the uphole portion from the downhole portion at a predetermined load; and deploying the line, the logging head, and the downhole tool into a well.

13. The method of claim 12 wherein attaching comprises attaching the logging head to a one of a wireline cable and coiled tubing.

14. The method of claim 12 further comprising performing at least one operation in the well with the downhole tool.

15. The method of claim 14 wherein performing comprises performing at least one logging operation with the downhole tool.

16. The method of claim 14 wherein performing comprises acquiring well profile data with the downhole tool.

17. The method of claim 12 wherein configuring comprises selecting a number of tensile members based on the predetermined load and disposing the selected number of tensile members in the tensile member compartments of the logging head, wherein the selected number of tensile members may be less than the number of tensile member compartments.

18. The method of claim 17 wherein selecting comprising selecting tensile members from a suite of interchangeable tensile members.

* * * * *